US005272903A

United States Patent [19]

Evans

[11] Patent Number: 5,272,903

[45] Date of Patent: Dec. 28, 1993

[54] HEMMING MACHINE

[75] Inventor: Owen C. Evans, Birmingham, Mich.

[73] Assignee: Craftmation, Inc., Troy, Mich.

[21] Appl. No.: 913,851

[22] Filed: Jul. 15, 1992

[51] Int. Cl.[5] ..... B21J 9/18

[52] U.S. Cl. ..... 72/403; 72/450; 29/243.58; 100/271; 100/280

[58] Field of Search ..... 72/380, 381, 323, 450, 72/451, 407, 403; 100/271, 281, 280; 29/243.58

[56] References Cited

U.S. PATENT DOCUMENTS

| | | | |
|---|---|---|---|
| 4,346,579 | 8/1982 | Takatsu | 72/314 |
| 4,706,489 | 11/1987 | Dacey, Jr. | 72/450 |
| 5,005,398 | 4/1991 | Evans | 72/450 |
| 5,035,136 | 7/1991 | Dorsett | 72/450 |

FOREIGN PATENT DOCUMENTS

| | | | |
|---|---|---|---|
| 1155414 | 10/1963 | Fed. Rep. of Germany . | |
| 686651 | 7/1930 | France | 72/323 |
| 200229 | 12/1965 | Sweden | 72/381 |
| 958671 | 5/1964 | United Kingdom . | |
| 958672 | 5/1964 | United Kingdom . | |
| 1075663 | 7/1967 | United Kingdom . | |

*Primary Examiner*—David Jones
*Attorney, Agent, or Firm*—Lyman R. Lyon

[57] ABSTRACT

A machine for hemming an edge portion of an arcuate panel having a fixed die with an arcuate contour complementary to the panel, a moveable die head having prehemming and hemming dies thereon with edge contours, respectively, complementary to the edge contour of said panel. A single fluid actuator and a cam controlled linkage effect both vertical and lateral movement of both the hemming die and prehemming die relative to the fixed die upon operation of the actuator. A pair of arms are pivotally attached to the prehemming die to form a radius of rotation which controls horizontal and vertical movement of the prehemming die relative to the moveable die head to provide proper clearance and disengagement between the prehemming die and the edge portion of the arcuate panel and/or the fixed die after completion of the prehemming operation.

4 Claims, 3 Drawing Sheets

HEMMING MACHINE

BACKGROUND OF THE INVENTION

The present invention relates to hemming machines used for reentrantly folding edge portions of metal panels to provide a smooth finished edge surface.

Hemming machines are utilized to reentrantly fold an edge portion of a primary panel against itself or against a secondary panel thereby to reinforce the primary panel edge and present a smooth finished edge surface. Initially, the edge of the primary panel is folded in the stamping process to an angle of approximately 90° relative to the surface thereof. The folded edge of the panel accommodates superposition of a secondary panel in juxtaposed relation thereto. Thereafter, the upstanding edge flange on the primary panel is reentrantly folded or "hemmed" to finish the edge and to secure the secondary panel, if used.

In order to condition the upstanding flange on a panel for hemming, it is necessary to reduce the angle of the upstanding flange from 90° relative to the panel to an angle short of its final folded position, for example 45°, but sufficient to insure proper folding of the flange when impacted by the hemming die. This is known in the art as "prehemming".

In commonly owned U. S. Pat. No. 5,005,398, incorporated by reference herein, a hemming machine is described which combines both prehemming and final hemming in a single machine and in a single cycle of operation. The machine is disclosed as utilizing a plurality of like gates which are operable pneumatically and are capable of relatively simple electronic control. The pneumatic cylinders are mounted on individual gates to provide for easy access. The gates can be operated individually or can be synchronized to hem all edges of a panel simultaneously. A unique mechanical toggle action linkage in combination with cam controlled movement of the hemming dies minimizes tolerance deviations in both the prehemming and the final hemming phases of the hemming cycle.

While the hemming machine taught in U. S. Pat. No. 5,005,398 operates effectively, the retracting path of the prehemming die carrier after completion of the prehem operation limits the hemming machine applicability to relatively flat panels. More particularly, the downward retraction of the prehemming die carrier does not allow the prehemming die to clear the outer bottom edge of a curved or arcuate panel after the panel fold has been prehemmed to 45°.

SUMMARY OF THE INVENTION

It is therefore an object of the prevent invention to provide a combination prehemming and hemming machine which reentrantly folds an edge portion of a curved or arcuate panel in a single cycle of operation.

It is also an object of the present invention to provide a combination prehemming and hemming machine which reentrantly folds an edge portion of a curved or arcuate primary panel against a superimposed secondary panel to produce a finished edge portion and to secure the secondary panel to the arcuate primary panel in a single cycle of operation.

In accordance with the present invention, a machine for prehemming and hemming an edge portion of an arcuate panel comprises a base, a fixed die on the base having an arcuate contour complementary to the arcuate panel, an upstanding arm having a lower end pivoted on the base, and a moveable die head. A first linkage is pivotally mounted to the arm and to the die head, respectively, so as to support die head movement relative to the arm. A prehemming die, which is carried by the die head, has a contour complementary to the edge contour of the arcuate panel in a prehemmed position and is moveable both horizontally toward the fixed die to contact with the edge portion of the arcuate panel and away from the fixed die to a retracted position to effect prehemming of the edge portion of the arcuate panel. A second linkage is pivotally mounted to the prehemming die and to the die head so as to support the horizontal movement of the prehemming die and to effect a small rotation of the prehemming die away from an edge portion of the fixed die when the prehemming die moves to the retracted position. A hemming die is mounted on the die head, and has a contour complementary to the edge contour of the arcuate panel in a hemmed position and the contour of the prehemming die. The hemming die is moveable vertically toward the fixed die to effect hemming of the edge portion of the arcuate panel. An actuator means effects both vertical and lateral movement of the die head relative to the fixed die. The second linkage comprises a pair of arms which are each pivotally engaged at different locations on the prehemming die, and with a respective one of a pair of pins affixed to the die head. The pair of arms and the pair of pins define a radius of horizontal and vertical movement for the prehemming die relative to the die head.

The present invention will be more fully understood upon reading the following detailed description of the preferred embodiment in conjunction with the accompanying drawings.

DETAILED DESCRIPTION OF THE PREFERRED EMBODIMENT OF THE INVENTION

Figure 1:
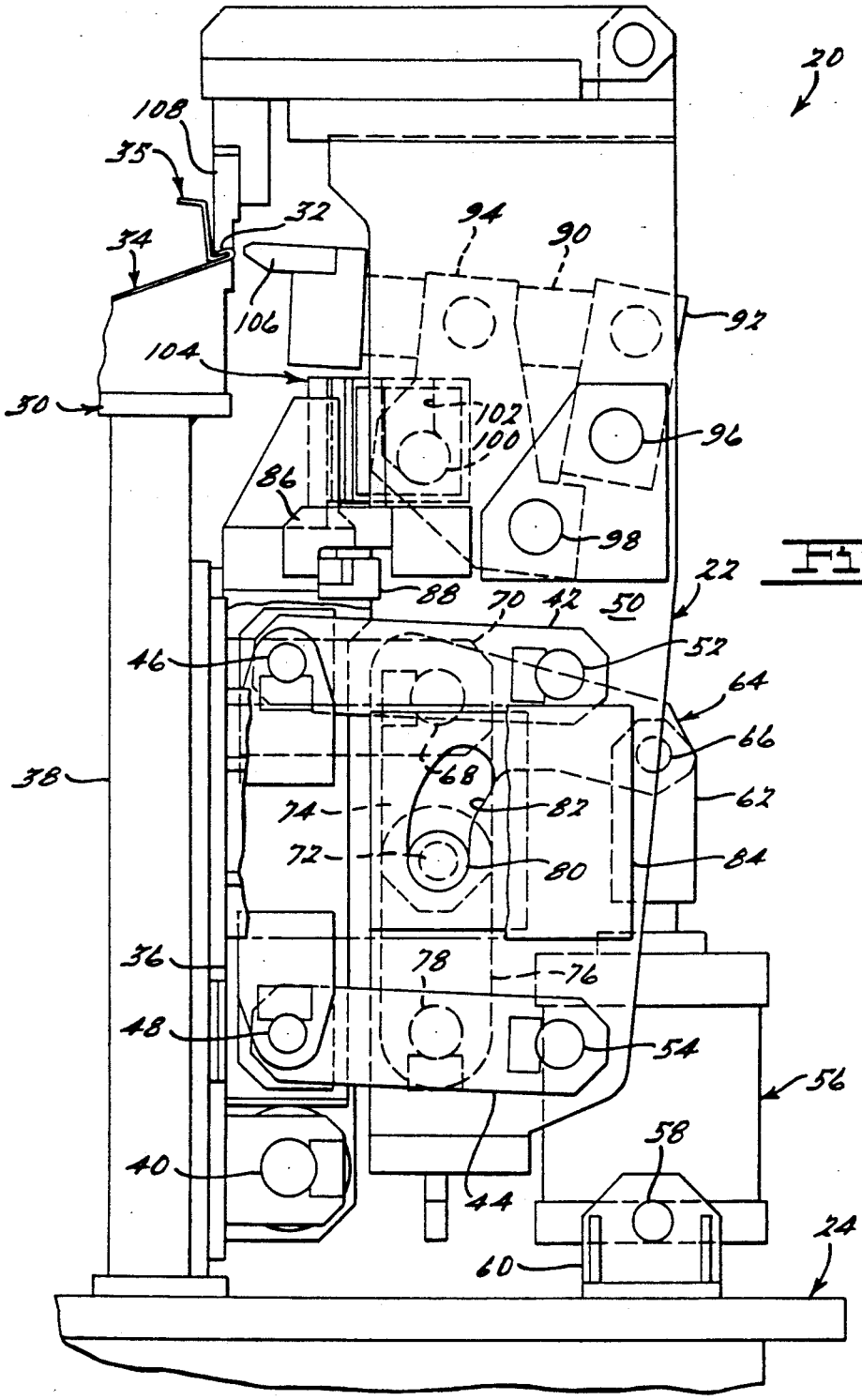
FIG. 1 is a fragmentary view, partially in section, of a single gate of the hemming machine of the present invention at the end of the hemming stroke.

As shown in FIG. 1, a hemming machine 20 in accordance with the present invention comprises a gate 22 which is mounted to a common base fixture 24. Gate 22 is constructed so as to operate a pair of moveable prehemming and hemming dies 106 and 108 attached thereon. The dies 106 and 108 cooperate with a fixed die 30 to effect hemming of an edge flange 32 of an arcuate primary panel 34 relative to a superimposed secondary panel 35, as will be described in more detail hereinbelow.

The gate 22 comprises an upstanding arm 36 that extends generally parallel to and is pivotally mounted on an upstanding stanchion 38 on the base 24 by a pin 40. The stanchion 38 also supports the fixed die 30 which has edge contours complementary to the contours of the panel 34 being hemmed.

A pair of links 42 and 44 are pivoted to the arm 36 by pins 46 and 48, respectively. The opposite ends of the links 42 and 44 are pinned to an upstanding moveable die head 50 by pins 52 and 54, respectively. Thus, the arm 36, links 42 and 44 and moveable die head 50 function as a collapsible parallelogram, the links of which are connected to one another by the pins 46, 48, 52, and 54.

Movement of the moveable die head 50 relative to the arm 36 is controlled by a pneumatic actuator 56 which is pivoted on a pin 58 journaled in a mounting bracket 60 on the base 24. A piston rod 62 of the pneumatic actuator 56 is pivotally secured to one end of a bell crank 64 by a pin 66. The bell crank 64 is pivotally supported by a pin 68 that is supported by a bracket 70 secured to the upstanding stanchion 38. A pin 72 joins an opposite end 74 of the bell crank 64 to a lower link 76 which, in turn, is pivotally secured to the moveable die head 50 by a pin 78.

Figure 2:
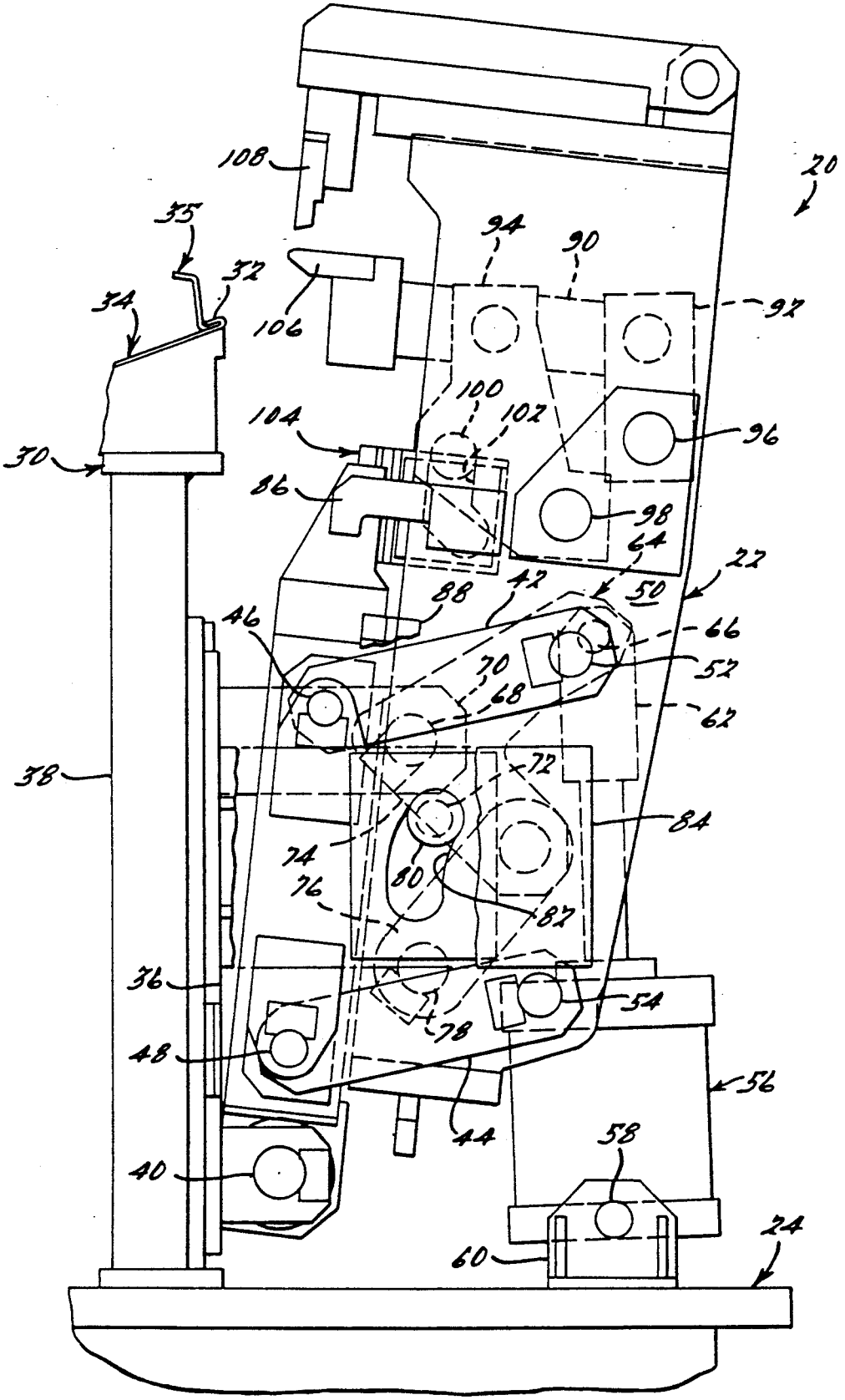
FIG. 2 is a view showing the gate of FIG. 1 in an elevated and laterally retracted condition for the removal of a hemmed panel and/or the acceptance of an arcuate panel to be hemmed.

Energization of the actuator 56 and extension of the rod 62 thereof affects rotation of the bell crank 64 about its support pin 68 to the position shown in FIG. 2, wherein the pin 72, link 76, pin 78 and moveable die head 50 are elevated to the position shown in FIG. 2.

In accordance with the present invention, upward movement of the moveable die head 50 is accompanied by lateral movement thereof. Such lateral movement is controlled by a circular cam or pin 80 which is carried by the moveable die head 50 and which moves in a cam slot 82 in a bracket 84 secured to the stanchion 38. Upward movement of the moveable die head 50 effects laterally outward rotation thereof and its supporting arm 36, as the cam 80 moves in the cam slot 82. Thus, extension of the actuator rod 62 effects both elevation and rotation of the moveable die head 50 to permit transfer of the arcuate panel 34 onto the fixed die 30. On retraction of the actuator rod 62 and downward movement of the die head 50, a locking finger 86 on the die head 50 engages a lock block 88 on the arm 36 to positively control relative movement between the die head 50 and arm 36 during the last increment of the hemming cycle, as will be described.

In accordance with the present invention, hemming machine 20 affects prehemming of the edge flange 32 of arcuate panel 34. Prehemming is required since the edge flange 32 is folded upwardly at an angle of approximately 90° from the surface of the panel in the stamping operation. Accordingly, the moveable die head 50 supports a prehemming die carrier that is carried upwardly and laterally relative to the arm 36 by the die head 50 as it moves upwardly and laterally. The prehemming die carrier comprises a shaft or arm 90 which is journaled in a pair of pivot linkages or bearing blocks 92 and 94. Bearing blocks 92 and 94 rotate about a pair of support pins 96 and 98 mounted to the moveable die head 50 to support rotation of bearing blocks 92 and 94, respectively, relative to two fixed points on the moveable die head 50. The arm 90 carries a transverse pin or cam 100 which is slidable in a cam slot 102 located in a bracket 104 affixed to arm 36. Thus, as the die head 50 moves upwardly relative to the arm 36, the prehemming die shaft 90 is moved laterally of the moveable die head 68 as controlled by the slope of the lower end of the cam slot 36 and the rotation radius formed by bearing blocks 92 and 94 relative to pins 96 and 98, thereby moving the prehemming die 106 relative to the hemming die 108, as will be described in greater detail hereinbelow.

Figure 3:
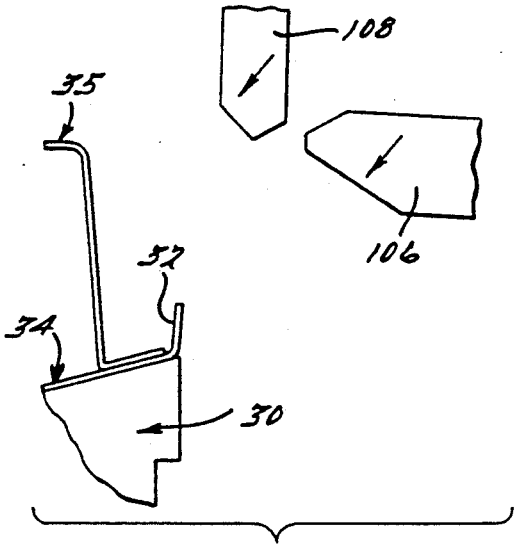
FIGS. 3–10 illustrate the sequence of movement of the moveable prehemming and hemming dies of the hemming machine through the hemming cycle.

As best seen in FIGS. 3 through 10 of the drawings, a cycle of operation of the hemming machine 20 starts from the condition shown in FIG. 2 of the drawings, namely, the open condition for the acceptance of primary and secondary panels 34 and 35. In this condition, the rod 62 of the pneumatic actuator 56 is in the fully extended condition and the bell crank 64 is fully rotated counterclockwise, as seen in the drawings, to an end position carrying the pin 72, link 76, pin 78, and die head 50 to their uppermost condition relative to the arm 36. After positioning of the panels 34 and 35 on the fixed die 30, movement of the actuator rod 62 in the retract direction affects downward movement of the die head 50 relative to the fixed die 30 through the aforesaid linkage. FIG. 3 is a fragmentary view illustrating the position of the hemming die 108 and the prehemming die 106 after the first increment of movement from the full open condition illustrated in FIG. 2.

Figure 4:
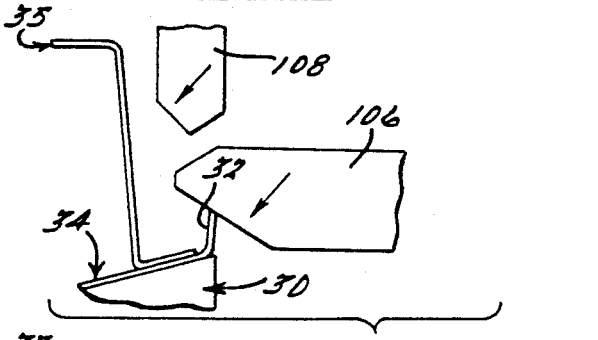

As seen in FIG. 4, as the die head 50 moves downwardly, it carries the prehemming die shaft 90, and prehemming die 106 mounted thereon, downwardly and counterclockwise whereby the prehemming die 106 engages the upstanding edge flange 32 on the primary panel 34.

Figure 5:
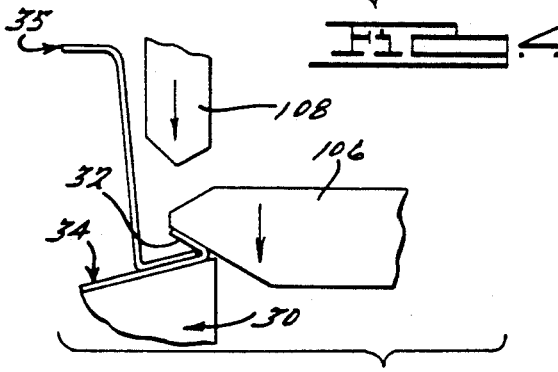

As seen in FIG. 5, as the moveable die head 50 continues to move downwardly, the prehemming die 106 continues to bias the flange 32 on the primary panel 34 counterclockwise to the prehem position shown in FIG. 5.

Figure 6:
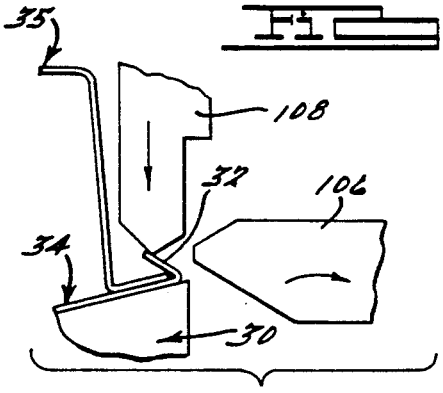

As seen in FIG. 6 of the drawings, the prehemming die 106 is retracted with a slight upward rotation away from the fixed die 30 due to movement of the pin 100 on the prehemming die shaft 90 within the slot 102 of bracket 104, and the rotation of bearing blocks 92 and 94 about pins 96 and 98. Prehemming die 106 and hemming die 108 are contoured so that movement of the prehemming die 106 clears the hemming die for engagement with the prehemmed flange 32 so as to bias the flange 32 downwardly to the position shown in FIG. 6 of the drawings.

Figure 7:
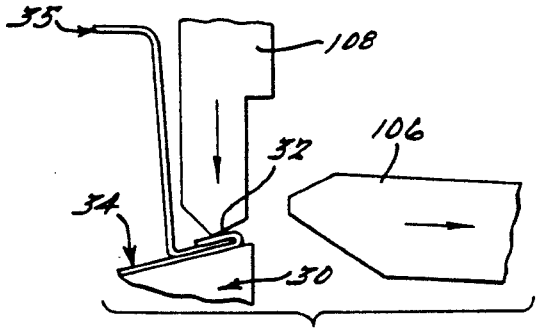

As seen in FIG. 7 of the drawings, full retraction of the rod 62 of the actuator 56 has carried the moveable die head 50 and hemming die 108 downwardly relative to the fixed die 30 to complete hemming of the flange 32 of the primary panel 34 relative to secondary panel 35.

Figure 8:
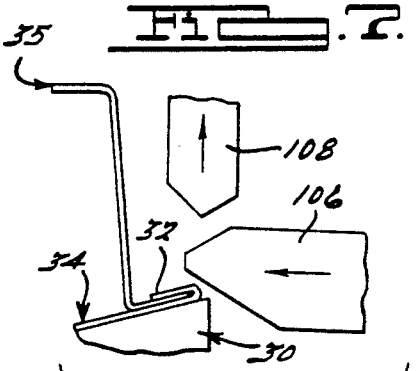

As seen in FIG. 8 of the drawings, initial upward movement of the rod 62 of the actuator 56 effects upward movement of the die head 50 and hemming die 108. The aforesaid movement of the die head 50 also effects lateral movement of the pin 100 in the cam slot 102 of bracket 104 which initiates movement of the prehemming die 106 towards the fixed hemming die 30.

Once prehemming die 106 has fully moved to the left relative to the fixed hemming die 30 as controlled by pin 100 reaching the horizontal portion of cam slot 102, the pin 100 begins to move vertically in the slot 102 in bracket 104 with no further effect on prehemming die 106.

Figure 9:
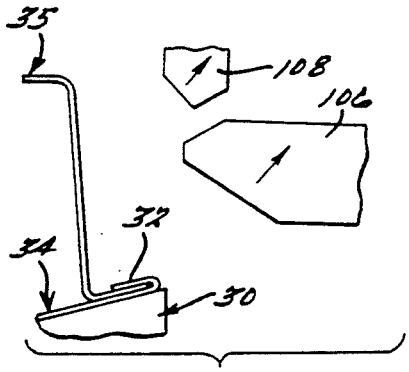
Figure 10:
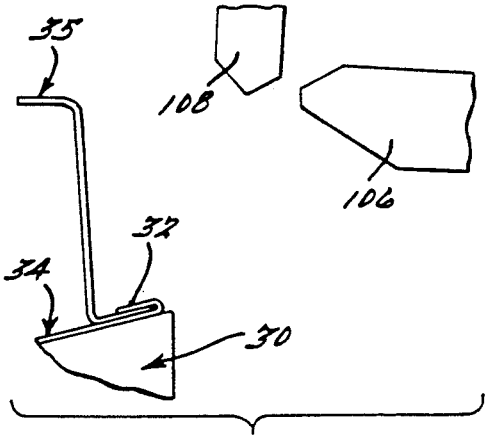

FIG. 9 shows the die head 50 moving away from the fixed hemming die 30 toward the uppermost condition in FIG. 10 with the hemming die 108 and prehemming die 106 substantially fully elevated and laterally retracted to facilitate removal of the hemmed workpiece from the fixed die 30. It is to be noted that a plurality of similar gates can be assembled into a single workstation which is synchronized to hem all edges of a panel simultaneously.

The hemming machine 20 of the present invention advantageously provides high speed, efficient prehemming and hemming of a curved or arcuate panel, while offering the user a clean, quiet working environment. The hemming machine of the present invention operates with a cycle time of approximately seven seconds on 60–85 psi air pressure. All cylinders of the machine 20 are mounted on an outer surface of the gate for easy access. The pneumatic controls of the machine are economical and durable.

The hemming machine of the present invention provides a controlled radius about which prehemming die arm 90 upwardly rotates while retracting from the curved edge of the fixed hemming die 30. The amount or angle of upward retracting movement of prehemming die arm 90 relative to fixed die 30 can be modified to provide sufficient clearance required by the particular curved edge of fixed hemming die 30. This modification is accomplished by physically changing the spatial relationship between support pins 96 and 98 to thereby modify the radius of rotation of prehemming die shaft 90.

It will be understood that the foregoing description of the preferred embodiment of the present invention is for illustrative purposes only, and that the various structural and operational features herein disclosed are susceptible to a number of modifications, none of which departs from the spirit and scope of the present invention as defined in the appended claims.

I claim:

1. A machine for hemming an edge portion of an arcuate panel comprising:

a base;

a fixed die on said base having an arcuate contour complementary to said arcuate panel;

an upstanding arm having a lower end pivoted on said base;

a moveable die head;

a first linkage pivotally mounted to said arm and to said die head, respectively, so as to support said die head for movement relative to said arm;

a prehemming die carried by said die head having a contour complementary to the edge contour of said arcuate panel in a prehemmed position and moveable both horizontally toward said fixed die to contact with said edge portion of said arcuate panel and away from said fixed die to a retracted position to effect prehemming of the edge portion of said arcuate panel;

a second linkage pivotally mounted to said prehemming die and to said die head so as to support the horizontal movement of said prehemming die and to effect a small rotation of said prehemming die away from an edge portion of said fixed die when said prehemming die moves to the retracted position, said second linkage comprising a pair of arms each pivotally engaged at different locations on said prehemming die, and with a respective one of a pair of pins affixed to said die head, said pair of arms and said pair of pins effecting the small rotation by defining an arcuate radius of horizontal and vertical movement for said prehemming die relative to said die head;

a hemming die on said die head having a contour complementary to the edge contour of said arcuate panel in a hemmed position and the contour of said prehemming die, said hemming die being moveable vertically toward said fixed die to effect hemming of the edge portion of said arcuate panel; and actuator means for effecting both vertical and lateral movement of said die head relative to said fixed die.

2. The hemming machine of claim 1 further comprising:

a cam surface secured to said arm; and a cam follower on said prehemming die engageable with said cam surface for effecting movement of said prehemming die relative to said hemming die.

3. The hemming machine of claim 1 wherein said actuator means comprises a fluid actuator having one end secured to said base and an opposite end controlling movement of said die head, energization of said fluid actuator effecting both vertical and horizontal movement of said die head relative to said fixed die.

4. The hemming machine of claim 1 wherein said first linkage comprises a pair of spaced links each connected at one end to said arm, respectively, and at the other end to said die head, respectively, whereby said arm, said links and said die head define a collapsible parallelogram.

* * * * *